US008130171B2

(12) United States Patent
Lam et al.

(10) Patent No.: US 8,130,171 B2
(45) Date of Patent: Mar. 6, 2012

(54) LENS FOR SCANNING ANGLE ENHANCEMENT OF PHASED ARRAY ANTENNAS

(75) Inventors: Tai Anh Lam, Kent, WA (US); Claudio G. Parazzoli, Seattle, WA (US); Minas Tanielian, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 646 days.

(21) Appl. No.: 12/046,940

(22) Filed: Mar. 12, 2008

(65) Prior Publication Data

US 2010/0277398 A1 Nov. 4, 2010

(51) Int. Cl.
*H01Q 15/02* (2006.01)

(52) U.S. Cl. ..... 343/909; 343/872

(58) Field of Classification Search ..... 343/909, 343/876, 767, 773; 333/219, 136; 359/796, 359/797, 676, 733, 708, 779, 761, 731, 748, 359/727, 681, 648, 760, 207.1, 642, 244, 359/245, 652, 298, 315, 654, 380, 679, 649, 359/356

See application file for complete search history.

(56) References Cited

U.S. PATENT DOCUMENTS

| | | | | |
|---|---|---|---|---|
| 3,877,014 | A | 4/1975 | Mailloux | |
| 5,283,587 | A | 2/1994 | Hirshfield et al. | |
| 5,905,472 | A | 5/1999 | Wolfson et al. | |
| 6,323,817 | B1 | 11/2001 | Ramanujam et al. | |
| 6,424,313 | B1 | 7/2002 | Navarro et al. | |
| 6,507,319 | B2 | 1/2003 | Sikina | |
| 6,670,930 | B2 | 12/2003 | Navarro | |
| 6,822,622 | B2 | 11/2004 | Crawford et al. | |
| 7,006,052 | B2 * | 2/2006 | Delgado et al. | 343/872 |
| 2005/0225492 | A1 * | 10/2005 | Metz | 343/753 |
| 2008/0165079 | A1 * | 7/2008 | Smith et al. | 343/911 R |
| 2008/0272955 | A1 | 11/2008 | Yonak et al. | |

FOREIGN PATENT DOCUMENTS

| | | | |
|---|---|---|---|
| EP | 1496570 | A1 | 1/2005 |
| WO | 2005093905 | A1 | 10/2005 |
| WO | 2006023195 | A2 | 3/2006 |

OTHER PUBLICATIONS

Fuchs et al., "Design Optimization of Multishell Luneburg Lenses", IEEE Transactions on Antennas and Propagation, vol. 55, No. 2, Feb. 2007, pp. 283-289.

(Continued)

*Primary Examiner* — Jacob Y Choi
*Assistant Examiner* — Jae Kim
(74) *Attorney, Agent, or Firm* — Yee & Associates, P.C.

(57) ABSTRACT

A method and apparatus for a negative index metamaterial lens. The method is used for creating a negative index metamaterial lens for use with a phased array antenna. A design is created for the negative index materials lens that is capable of bending a beam generated by the phased array antenna to around 90 degrees from a vertical orientation to form an initial design. The initial design is modified to include discrete components to form a discrete design. Materials are selected for the discrete components. Negative index metamaterial unit cells are designed for the discrete components to form designed negative index metamaterial unit cells. The designed negative index metamaterial unit cells are fabricated to form fabricated designed negative index metamaterial unit cells. The negative index metamaterial lens is formed from the designed negative index metamaterial unit cells.

17 Claims, 12 Drawing Sheets

OTHER PUBLICATIONS

Gutman, "Modified Luneberg Lens" Journal of Applied Physics, vol. 25, No. 7, Jul. 1954, pp. 855-859.
Simon, "Analysis and Synthesis of Rotman Lenses", 22nd AIAA International Communications Satellite Systems Conference & Exhibit 2004, May 2004, Monterey, CA, pp. 1-11.
Parazzoli et al., "Eikonal equation for a general anisotropic or chiral medium: application to a negative-graded index-of-refraction lens with an anisotropic material", Journal of Optical Society of America, vol. 23, No. 3, Mar. 2006, pp. 439-450.
U.S. Appl. No. 12/689,003, file date: Jan. 18, 2010, Lam et al.
U.S. Appl. No. 12/411,575, file date: Mar. 26, 2009, Lam et al.
U.S. Appl. No. 12/491,554, file date: Jun. 25, 2009, Lam et al.
U.S. Appl. No. 12/621,957, file date: Nov. 19, 2009, Greegor et al.
Schoenlinner et al., "Wide-Scan Spherical-Lens Antennas for Automotive Radars", IEEE Transactions on Microwave Theory and Techniques, vol. 50, No. 9, Sep. 2002, pp. 2166-2175.
Mosallaei et al., "Nonuniform Luneburg and Two-Shell Lens Antennas: Radiation Characteristics and Design Optimization", IEEE Transactions on Antennas and Propagation, vol. 49, No. 1, Jan. 2001, pp. 60-69.
Xu et al., "Report on steerable antenna architectures and critical RF circuits performance", FP6-IST-2003-506745 Capanina, Information Society Technologies, Nov. 2006, pp. 1-85.
Parazzoli et al., "Experimental Verification and Simulation of Negative Index of Refraction Using Snell's Law", Physical Review Letters, vol. 90, No. 10, Mar. 14, 2003, The American Physical Society, pp. 1-4.
Schrank et al., "A Luneberg-Lens Update", IEEE Antennas and Propagation Magazine, vol. 37, No. 1, Feb. 1995, pp. 77-79.
PCT International Search Report for application PCT/US2010/053247 dated Feb. 2, 2011.
Lam et al., "Experimental observation of the electric coupling effect in split ring resonators and the prevention", Physica Status Solidi a Wiley-VCH Verlag GMBH Germany, vol. 204, No. 12, Dec. 2007, pp. 3975-3978.
Mohd Asmidar Bin Abdul Wahab et al., "An investigation of square split-ring resonator as antenna operating at Terahertz frequency", Applied Electromagnetics, 2007, Asia Pacific Conference on, IEEE Piscataway NH, Dec. 4, 2007, pp. 1-6.
Ortiz et al., "Complementary split-ring resonator for compact waveguide filter design", Microwave and Optical Technology Letters, Wiley IUSA, vol. 46, No. 1, Jul. 5, 2005, pp. 88-92.
Bilotti et al., "Theoretical and experimental analysis of magnetic inclusionsfor the realization of metamaterials at different frequencies", Microwave Symposium 2007 IEEE/MTT-S International, IEEE, Jun. 1, 2007, pp. 1835-1838.
Jitha et al., "SRR loaded waveguide band rejection filter with adjustable bandwidth", Microwave and Optical Technology Letters, Wiley USA, vol. 48, No. 7, Jul. 2006, pp. 1427-1429.
PCT search report for application PCT/US2010/028364 dated Dec. 30, 2010.
Bahrami et al., "Using Complementary split ring resonators to design bandpass waveguide filters", 2007 Asia-Pacific Microwave Conference, Bangkok, IEEE, Jun. 2008, 4 pages.
Pendry et al., "The Quest for the Superlens", Jul. 2006, retrieved Dec. 14, 2010 http://www.cmth.ph.ic.ac.uk/photonics/Newphotonics/pdf/sciam-pendry-4a.pdf.
Dong et al., "A Fast Ray-Trading Method for Microstrip Rotman Lens Analysis", Proceedings of 29th General Assembly of the International Union of Radio Science, Chicago IL, Aug. 2008, pp. 1-4.
Penney et al., "Broad Band Rotman Lens Simulations in FDTD", IEEE, Jul. 2005, pp. 51-54.
Rausch et al., "Rotman Lens Design Issues", IEEE, Jul. 2005, pp. 35-38.
Rotman et al., "Wide-Angel Microwave Lens for Line Source Applications", IEEE Transactions on Antennas and Propagation, Nov. 1963, pp. 623-632.
Lam et al., "Negative Index Metamaterial Lens for the Scanning Angle Enhancement of Phased-Array Antennas", Zouhdi et al. (eds.), Metamaterials and Plasmonics: Fundamentals, Modelling, Applications, The NATO Science for Peace and Security Programme, Springer Science + Business Media B.V., Jan. 2009, pp. 121-138.
Sparks et al., "Eight Beam Prototype Fiber Optic Rotman Lens", Nov. 1999 IEEE MW'99 Digest, pp. 283-286.
Rahm et al., "Design of electromagnetic cloaks and concentrators using form-invariant coordinate transformations of Maxwell's equations", Photonics and Nanostructures—Fundaments and Applications, vol. 6, Issue 1, Apr. 2008, pp. 87-95.
Greegor et al., "Microwave focusing and beam collimation using negative index of refraction lenses", IET Microw. Antennas Propag., vol. 1, Issue 1, Feb. 2007, pp. 108-115.

* cited by examiner

LENS FOR SCANNING ANGLE ENHANCEMENT OF PHASED ARRAY ANTENNAS

GOVERNMENT LICENSE RIGHTS

This invention was made with Government support under HR0011-05-C-0068 awarded by DARPA. The Government has certain rights in this invention.

BACKGROUND INFORMATION

1. Field

The present disclosure relates generally to lenses and in particular to lenses for use with phased array antennas. Still more particularly, the present disclosure relates to a method and apparatus for a negative index metamaterial lens for scanning angle enhancement of phased array antennas.

2. Background

Phased array antennas have many uses. For example, phased array antennas may be used in broadcasting amplitude modulated and frequency modulated signals for various radio stations. As another example, phased array antennas are commonly used with seagoing vessels, such as warships. Phased array antennas allow a warship to use one radar system for surface detection and tracking, air detection and tracking, and missile uplink capabilities. Further, phased array antennas may be used to control missiles during the course of the missile's flight.

Phased array antennas also are commonly used to provide communications between various vehicles. Phased array antennas also are used in communications with spacecraft. As another example, the phased array antenna may be used on a moving vehicle or seagoing vessel to communicate with an aircraft.

The elements in a phased array antenna may emit radio frequency signals to form a beam that can be steered through different angles. The beam may be emitted normal to the surface of the elements radiating the radio frequency signals. Through controlling the manner in which the signals are emitted, the direction may be changed. The changing of the direction is also referred to as steering. For example, many phased array antennas may be controlled to direct a beam at an angle of around 60 degrees from a normal direction from the arrays in the antenna. Depending on the usage, ability, or capability to direct the beam at a higher angle, such as, for example, around 90 degrees, may be desirable.

Some currently used systems may employ a mechanically steered antenna to achieve greater angles. In other words, the antenna unit may be physically moved or tilted to increase the angle at which a beam may be steered. These mechanical systems may move the entire antenna. This type of mechanical system may involve a platform that may tilt the array in the desired direction. These types of mechanical systems, however, move the array at a rate that may be slower than desired to provide a communications link.

Therefore, it would be advantageous to have a method and apparatus to overcome the problems described above.

SUMMARY

The different advantageous embodiments provide a method and apparatus for a negative index metamaterial lens. In one advantageous embodiment, the method is used for creating a negative index metamaterial lens for use with a phased array antenna. A design is created for the negative index materials lens that is capable of bending a beam generated by the phased array antenna to around 90 degrees from a vertical orientation to form an initial design. The initial design is modified to include discrete components to form a discrete design. Materials are selected for the discrete components. Negative index metamaterial unit cells are designed for the discrete components to form designed negative index metamaterial unit cells. The designed negative index metamaterial unit cells are fabricated to form fabricated designed negative index metamaterial unit cells. The negative index metamaterial lens is formed from the designed negative index metamaterial unit cells.

In another advantageous embodiment, a method is present for creating a lens for a phased array antenna. An array of radio frequency emitters capable of emitting a beam that is steerable to a first angle relative to a vertical orientation is identified. A negative index metamaterial lens is formed that is capable of bending the beam emitted by the array of radio frequency emitters to a desired angle relative to the vertical orientation.

In yet another advantageous embodiment, an apparatus comprises a negative index metamaterial lens and an array. The negative index metamaterial lens has a configuration capable of bending a radio frequency beam to a selected angle relative to a normal vector. The array is capable of emitting the radio frequency beam.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives and advantages thereof, will best be understood by reference to the following detailed description of an advantageous embodiment of the present disclosure when read in conjunction with the accompanying drawings, wherein:

DETAILED DESCRIPTION

Figure 1:
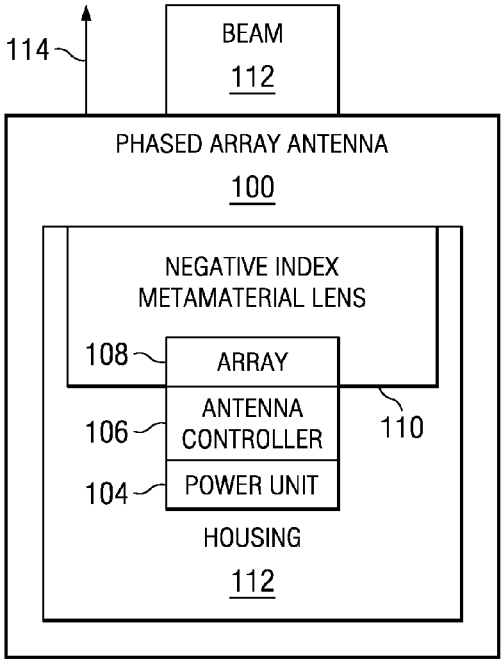
FIG. 1 is a block diagram illustrating a phased array antenna in which an advantageous embodiment may be implemented.

With reference now to the figures and in particular with reference to FIG. 1, a block diagram illustrating a phased array antenna is depicted in accordance with an advantageous embodiment. In this example, phased array antenna 100 includes housing 102, power unit 104, antenna controller 106, array 108, and negative index metamaterial lens 110. Housing 102 is the physical structure containing different elements of phased array antenna 100. Power unit 104 provides power in the form of voltages and currents needed by phased array antenna 100 to operate. Antenna controller 106 provides a control system to control the emission of microwave signals by array 108. These microwave signals are radio frequency emissions that may be emitted by array 108.

Array 108 is an array of microwave transmitters. Each of these microwave transmitters may also be referred to as an element or radiator. In these examples, each of the transmitters within array 108 is connected to antenna controller 106. Antenna controller 106 controls the emission of radio frequency signals in a manner that generates beam 112. In particular, antenna controller 106 may control the phase and timing of the transmitted signal from each of the transmitters in array 108. In other words, each of the elements within array 108 may transmit signals using a different phase and timing with respect to other transmitters in array 108. The combined individual radiated signals form the constructive and destructive interference patterns of the array in the manner that beam 112 may be directed at different angles from array 108.

In these examples, beam 112 may radiate in a number of different directions relative to normal vector 114. Normal vector 114 is in a direction normal to a plane on which array 108 is formed. Typically, antenna controller 106 may control or steer beam 112 in a fashion that beam 112 radiates either at zero degrees with respect to normal vector 114 up to around 60 degrees from normal vector 114.

In the advantageous embodiments, negative index metamaterial lens 110 provides the capability to increase the angle from normal vector 114 past the typically available vector around 60 degrees. In the different advantageous embodiments, negative index metamaterial lens 110 bends beam 112 to an angle of around 90 degrees from normal vector 114. This bending increases the angle from which beam 112 may be steered.

Negative index metamaterial lens 110 allows for this type of directing of beam 112 without requiring moving mechanical components as in currently used solutions. A metamaterial is a material that gains its properties from the structure of the material rather than directly from its composition. A metamaterial may be distinguished from other composite materials based on unusual properties that may be present in the metamaterial.

For example, the metamaterial may have a structure with a negative refractive index. This type of property is not found in naturally occurring materials. The refractive index is a measure of how the speed of light or other waves are reduced in a medium.

Further, a metamaterial also may be designed to have negative values for permittivity and permeability. Permittivity is a physical quantity that describes how an electrical field affects and is affected by a dielectric medium. Permeability is a degree of magnetism of a material that responds linearly to an applied magnetic field. In the different advantageous embodiments, negative index metamaterial lens 110 is a lens that is formed with a metamaterial that has a negative index of refraction. This lens may also include other properties or attributes to bend beam 112.

The different advantageous embodiments recognize that a lens using a positive index also may be employed within phased array antenna 100. The different advantageous embodiments, however, recognize that this type of lens results in a structure that may be too large with respect to housing 102. This type of lens may protrude from housing 102 and may result in aerodynamic concerns, depending on the type of implementation. As a result, the different advantageous embodiments use a negative index metamaterial to form the lens used in phased array antenna 100.

Figure 2:
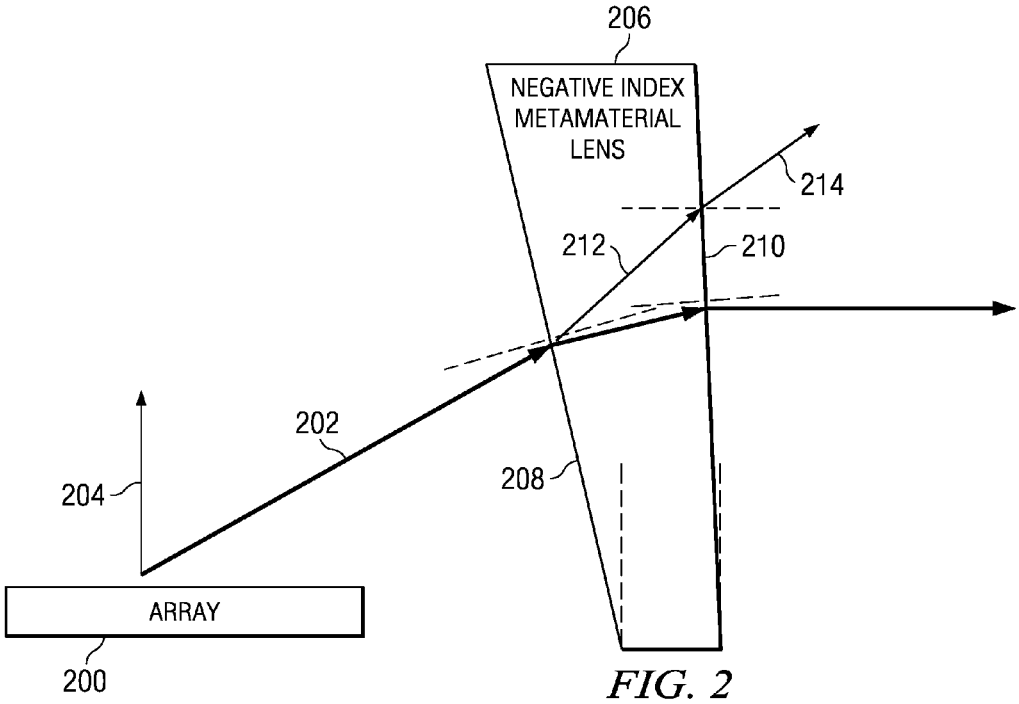
FIG. 2 is a diagram illustrating the operation of a phased array antenna using a negative index metamaterial lens in accordance with an advantageous embodiment.

Turning now to FIG. 2, a diagram illustrating the operation of a phased array antenna using a negative index metamaterial lens is depicted in accordance with an advantageous embodiment. In this example, array 200 is an example of an array, such as array 108 in FIG. 1. Array 200 may be, for example, a 64 element array. In this type of implementation, an 8×8 array may be arranged in a triangular lattice. Of course, the different advantageous embodiments may be applied to other types and sizes of arrays.

In this illustrative example, array 200 outputs beam 202. Beam 202 is a radio frequency emission generated by the different elements in array 200. The transmission of signals by array 200 occurs in a manner that beam 202 is steered in a direction that is around 60 degrees from normal 204. Beam 202 enters negative index metamaterial lens 206 at surface 208. Negative index metamaterial lens 206 is shown in cross-section and is an example of negative index metamaterial lens 110 in FIG. 1.

As beam 202 travels through negative index metamaterial lens 206, beam 202 is bent or directed in a manner that beam 202 is emitted or exits negative index metamaterial lens 206 at surface 210 in a direction that is around horizontal. Of course, the final direction of beam 202 may vary depending on the steering of beam 202 prior to entering negative index metamaterial lens 206. The path indicated by arrows 212 and 214 show a beam path with normal material used for a lens. As can be seen, in this path a direction that is around horizontal does not occur.

Figure 3:
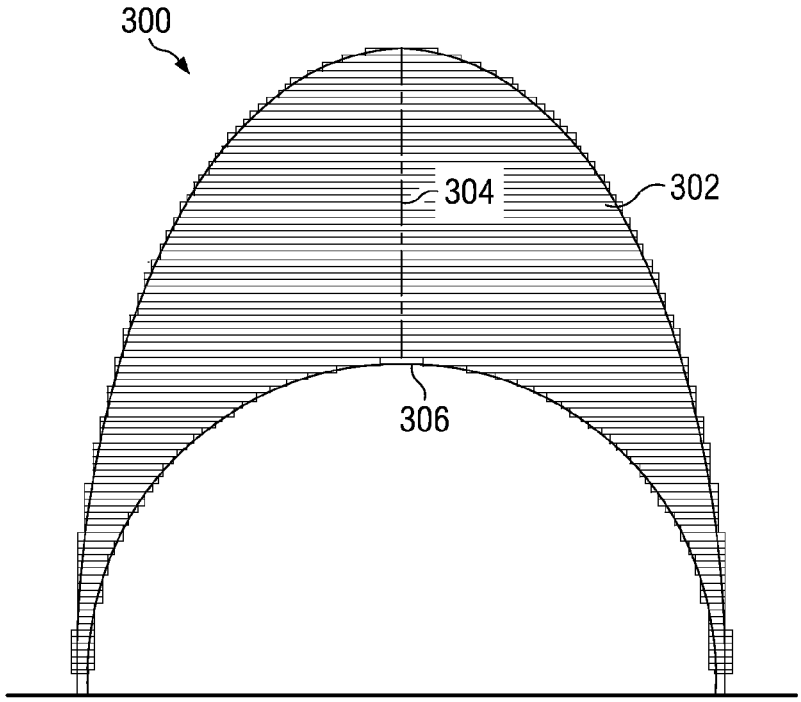
FIG. 3 is an example of a negative index metamaterial lens design in accordance with an advantageous embodiment.

A negative index metamaterial lens may have a number of different forms. In the advantageous embodiments, a negative index metamaterial lens is designed based on two curves, such as parabolas. Turning now to FIG. 3, an example of a negative index metamaterial lens is depicted in accordance with an advantageous embodiment. In this example, lens 300 is an example of an index metamaterial lens that may be used with a phased array antenna.

In this example, lens 300 includes negative index metamaterial unit cells 302 between ellipse 304 and ellipse 306.

Negative index metamaterial unit cells 302 form the material for lens 300. In these illustrative examples, negative index metamaterial unit cells 302 are placed between ellipse 304 and ellipse 306 in layers. In these illustrative examples, ellipse 304 and ellipse 306 are only outlines of boundaries for lens 300. These ellipses are not actually part of lens 300.

The layers containing negative index metamaterial unit cells 302 are aligned with other layers of these unit cells to maintain a crystalline stacking. Crystalline stacking occurs when the unit cell boundaries of one layer are aligned with unit cell boundaries in another layer. Non-crystalline stacking occurs if the boundaries between unit cells different layers are not aligned. The height of each layer is one unit cell thick while the width of each layer may be a number of unit cells or a single unit cell designed to the appropriate size.

Figure 4:
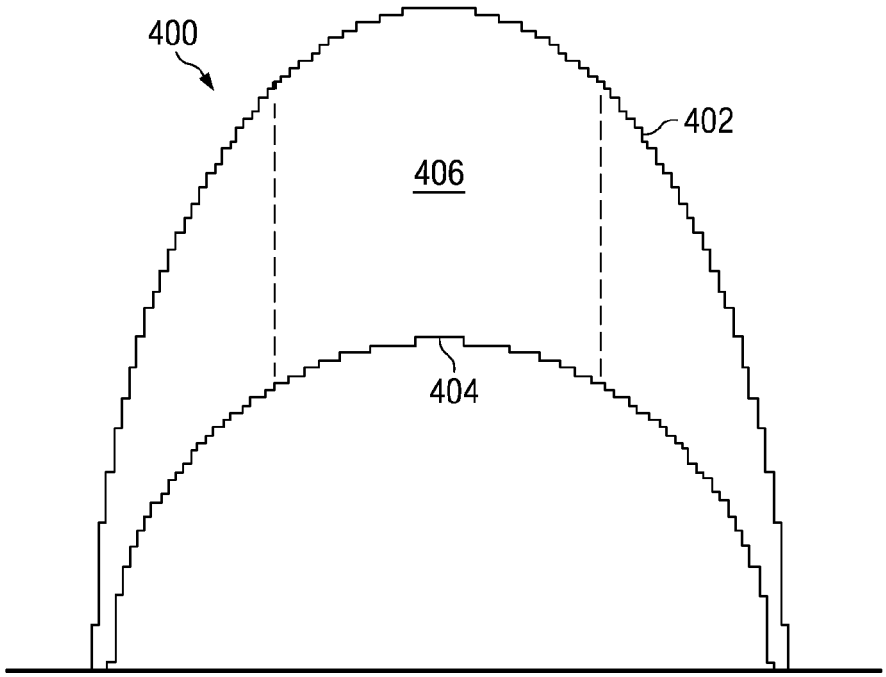
FIG. 4 is a diagram illustrating an outline of a negative index metamaterial lens in accordance with an advantageous embodiment.

Turning now to FIG. 4, a diagram illustrating an outline of a negative index metamaterial lens is depicted in accordance with an advantageous embodiment. Lens outline 400 is an outline of a negative index metamaterial lens, such as lens 300 in FIG. 3.

In this example, lens outline 400 results from the placement of negative index metamaterial cells between ellipses 304 and 306 in FIG. 3. Lens outline 400 has outer edge 402 and inner edge 404. Lens outline 400 has a discrete or jagged look. In actual implementation, this design may be rotated 360 degrees to form a three-dimensional design for a negative index metamaterial lens.

Additionally, lens outline 400 may have a portion removed, such as a portion within section 406, to reduce weight and interference for directions in which additional bending of a beam is unnecessary.

Figure 5:
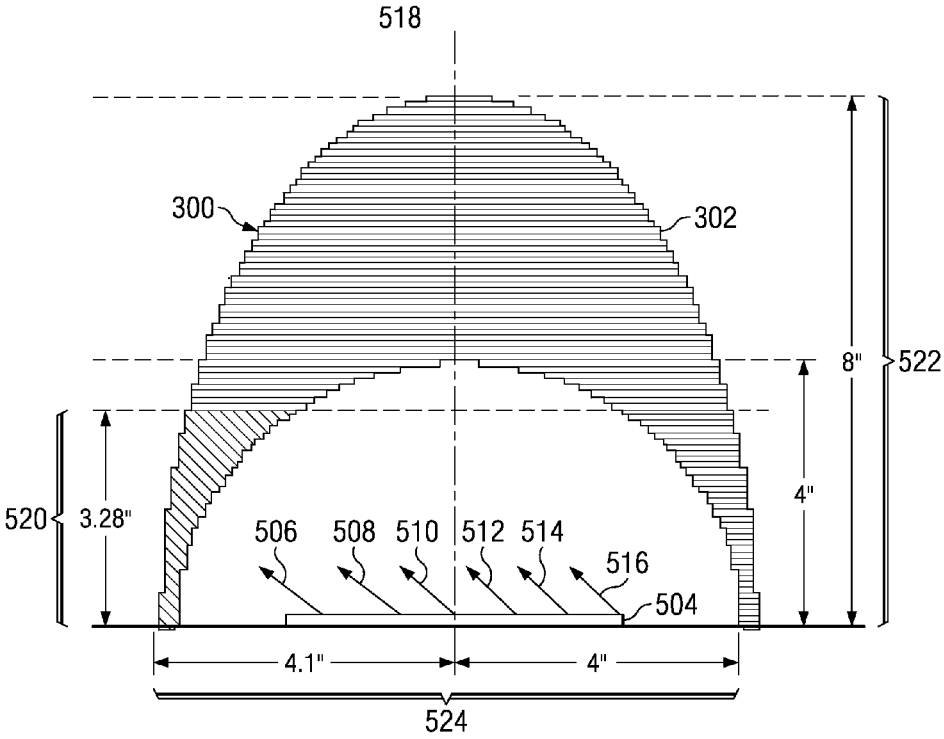
FIG. 5 is a diagram illustrating a cross-section of a lens in relation to an array for a phased array antenna in accordance with an advantageous embodiment.

With reference now to FIG. 5, a diagram illustrating a cross-section of a lens in relation to an array for a phased array antenna is depicted in accordance with an advantageous embodiment. In this example, lens 300 is shown with respect to array 504. Array 504 is an array of radio frequency emitters. In particular, array 504 may emit radio frequency signals in the form of microwave transmissions.

Array 504 may emit radio frequency emissions 506, 508, 510, 512, 514, and 516 to form a beam that may be transmitted at an angle of around 60 degrees with respect to normal vector 518.

Lens 300 is designed, in this example, with the inner ellipse having a circle of around 4 inches, an outer ellipse having a semi-major axis of 8 inches, and a semi-minor axis of 4.1 inches. In this example, lens 300 may be designed to only include a portion of lens 300 within section 520. In this example, lens 300 may have a height of around 8 inches as shown in section 522. Lens 300 may have a width of around 8.1 inches as shown in section 524.

Of course, the illustration of lens 300 in FIG. 5 is shown as a two-dimensional cross-section of a negative index metamaterial lens.

Figure 6:
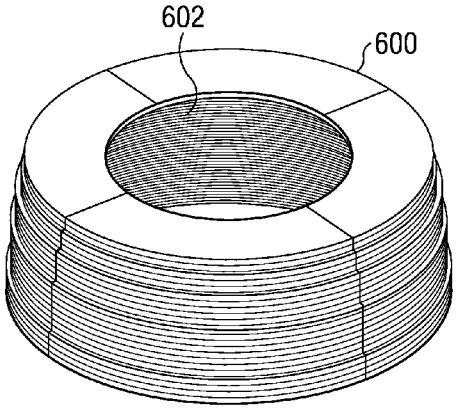
FIG. 6 is a diagram of a lens in accordance with an advantageous embodiment.

Turning now to FIG. 6, a diagram of a lens is depicted in accordance with an advantageous embodiment. In this illustrative example, lens 600 is presented in a perspective view. Lens 600 is the portion of lens 300 in section 520 in FIG. 5. In this example, the array of antenna elements is located within channel 602 of lens 600. In this example, the array is not visible.

Figure 7:
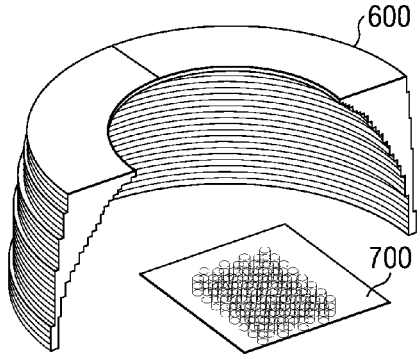
FIG. 7 is a cross-sectional view of a lens in accordance with an advantageous embodiment.

With reference now to FIG. 7, a cross-sectional perspective view of lens 600 is depicted in accordance with an advantageous embodiment. In this example, array 700 is an example of an array of antenna elements for a phased array antenna that may be present. This cross-sectional perspective view is presented to show a perspective view of array 700 with a portion of lens 600.

Figure 8:
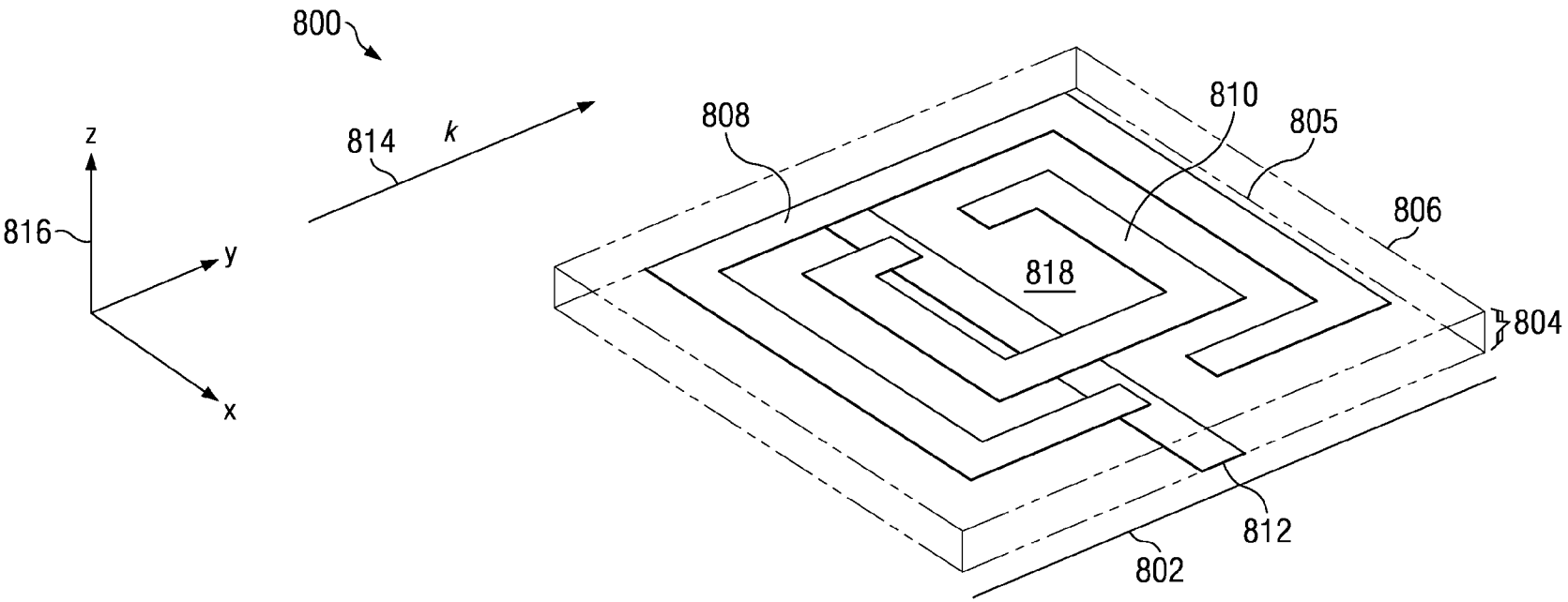
FIG. 8 is a diagram of a cell in accordance with an advantageous embodiment.

With reference now to FIG. 8, a diagram of a cell is depicted in accordance with an advantageous embodiment. In this example, cell 800 is an example of a negative index metamaterial unit cell that may be used to form a lens, such as lens 400 in FIG. 4. As depicted, cell 800 is square shaped. Cell 800 has length 802 along each of the sides and height 804. In these examples, length 802 may be, for example, around 2.3 millimeters. Height 804 may be the height of the substrate. For example, the height may be around 10 millimeters. These dimensions may vary depending on the particular implementation. Cell 800 comprises substrate 806.

Substrate 806 provides support for copper rings and wire traces, such as split ring resonator 805, which includes traces 808 and 810. Additionally, substrate 806 also may contain trace 812. In these examples, substrate 806 may have a low dielectric loss tangent to reduce the over loss of the unit cell. In these examples, substrate 806 may be, for example, alumina. Another example of a substrate that may be used is an RT/Duroid® 5870 high frequency laminate. This type of substrate may be available from Rogers Corporation. Of course, any type of material may be used for substrate 806 to provide a mechanical carrier of structure for the arrangement and design of the different traces to achieve the desired E and H fields.

Split ring resonator 805 is used to provide some of the properties to generate a negative index of refraction for cell 800. Traces 808 and 810 provide negative permeability for a magnetic response. Split ring resonator 805 creates a negative permeability caused by the reaction of the pattern of these traces to energy. Trace 812 also provides for negative permittivity.

In this example, wave propagation vector k 814 is in the y direction as indicated by reference axis 816. Split ring resonator 805 couples the Hz component to provide negative permeability in the z direction. Trace 812 is a wire that couples the Ex component providing negative permittivity in the x direction by stacking cell 800 with cells in other planes coupling of other E and H field components may be achieved.

Although a particular pattern is shown for split ring resonator 805, other types of pattern may be used. For example, the patterns may be circular rather than square in shape for split ring resonator 805. Various parameters may be changed in split ring resonator 805 to change the permeability of the structure. For example, the orientation of split ring resonator 805, with respect to trace 812, can change the magnetic permeability of cell 800.

As another example, the width of the loop formed by trace 808, the width of the inner loop formed by trace 810, the use of additional paramagnetic materials within area 818, and a type of pattern as well as other changes in the features of cell 800 may change the permeability of cell 800. The permittivity of cell 800 also may be changed by altering various components, such as the material for trace 812, the width of trace 812, and the distance of trace 812 from split ring resonator 805.

Figure 9:
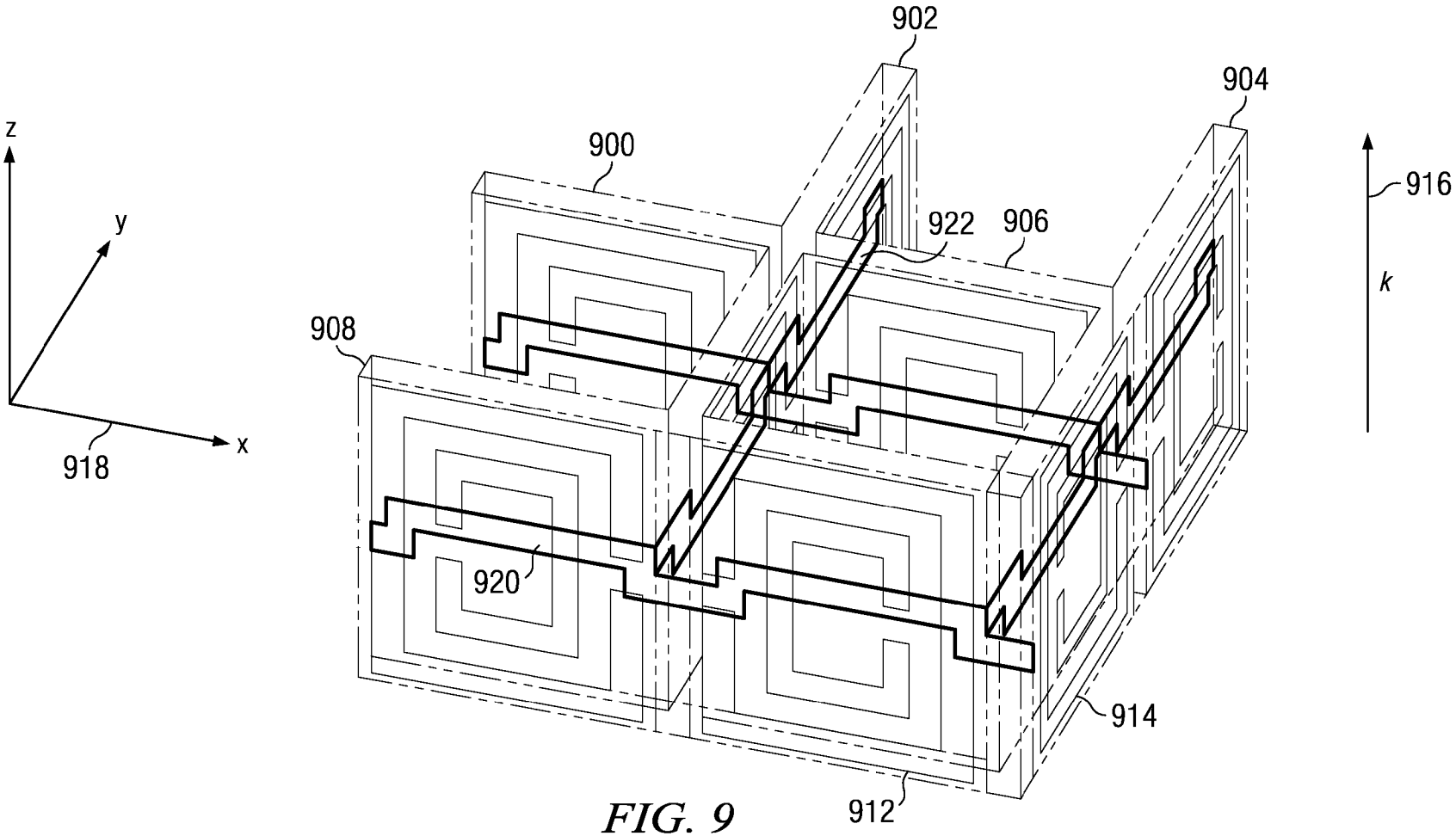
FIG. 9 is a unit cell arrangement in accordance with an advantageous embodiment.

With reference now to FIG. 9, a unit cell arrangement is depicted in accordance with an advantageous embodiment. In this example, unit cells 900, 902, 904, 906, 908, 912, and 914 are depicted. These unit cells are similar to cell 800 in FIG. 8. In this example, wave vector k 916 is in the z direction with reference to axis 918. Permittivity and permeability are negative both in the x and y directions with this type of architecture. A notch, such as notch 920 and notch 922, is present in the y wires so that they do not cross each other in these examples. To avoid wire intersections, routing notches are included at the cell boundary. The notches and the stacking of cells are shown in more detail with respect to FIGS. 10 and 11 below.

Figure 10:
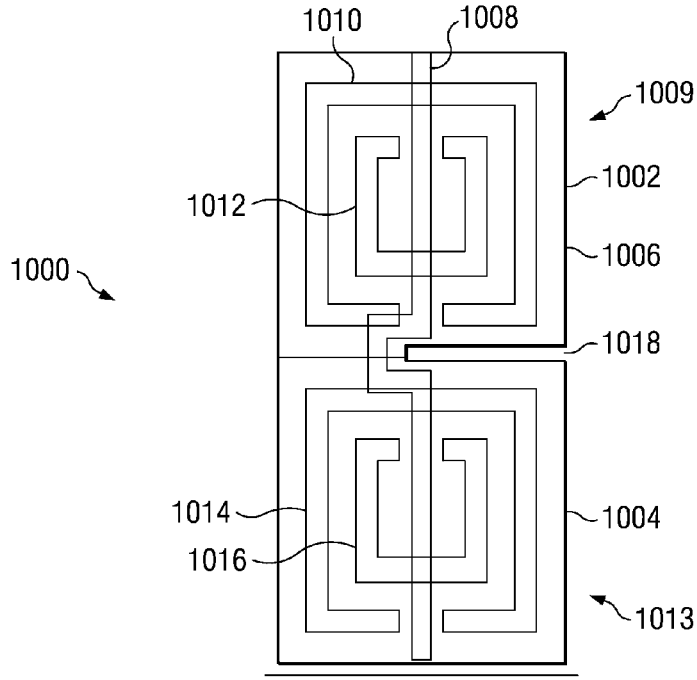
FIG. 10 is a diagram illustrating two unit cells in accordance with an advantageous embodiment.

With reference now to FIG. 10, a diagram illustrating two unit cells is depicted in accordance with an advantageous embodiment. In this example, element 1000 includes unit cell 1002 and unit cell 1004 performed in substrate 1006. Wire trace 1008 runs through both unit cells 1002 and 1004. Unit cell 1002 has split ring resonator 1009 formed by traces 1010 and 1012. Unit cell 1004 has split ring resonator 1013 formed by traces 1014 and 1016. As can be seen in this illustration, element 1000 has notch 1018 between unit cells 1002 and 1004 to allow for perpendicular stacking and/or assembly.

Figure 11:
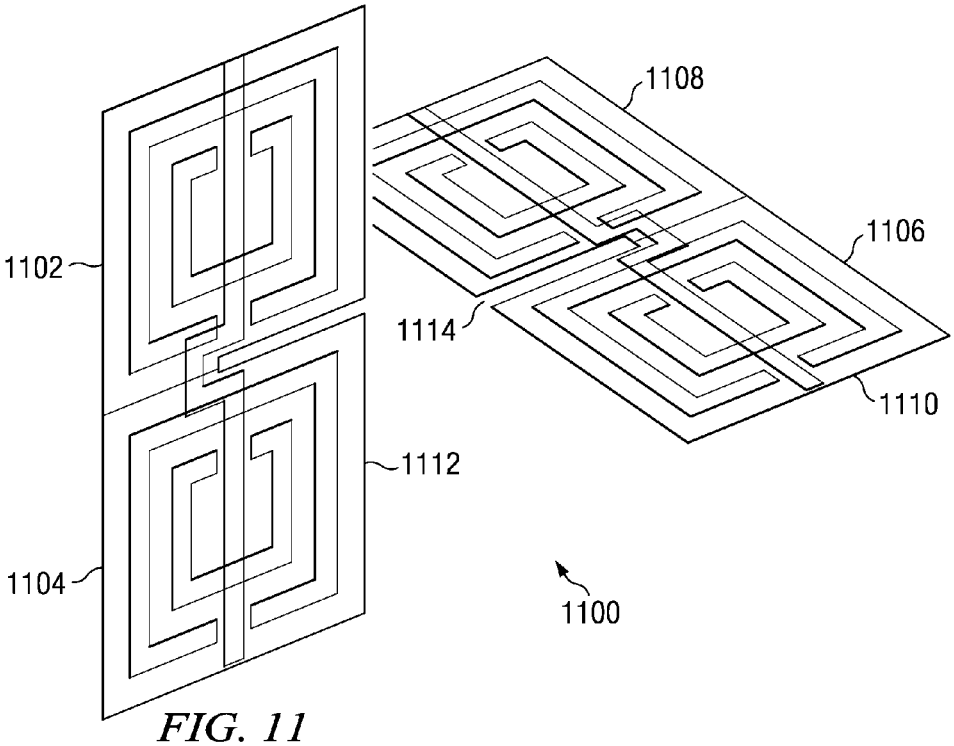
FIG. 11 is an illustration of unit cells positioned for assembly in accordance with an advantageous embodiment.

With reference now FIG. 11, an illustration of unit cells positioned for assembly is depicted in accordance with an advantageous embodiment. In this example, element 1100 includes unit cells 1102 and 1104. Element 1106 contains unit cells 1108 and 1110. As can be seen, notches 1112 and 1114 are present in elements 1100 and 1106. Elements 1100 and 1106 are positioned to allow engagement for assembly for these two elements at notches 1112 and 1114.

Figure 12:
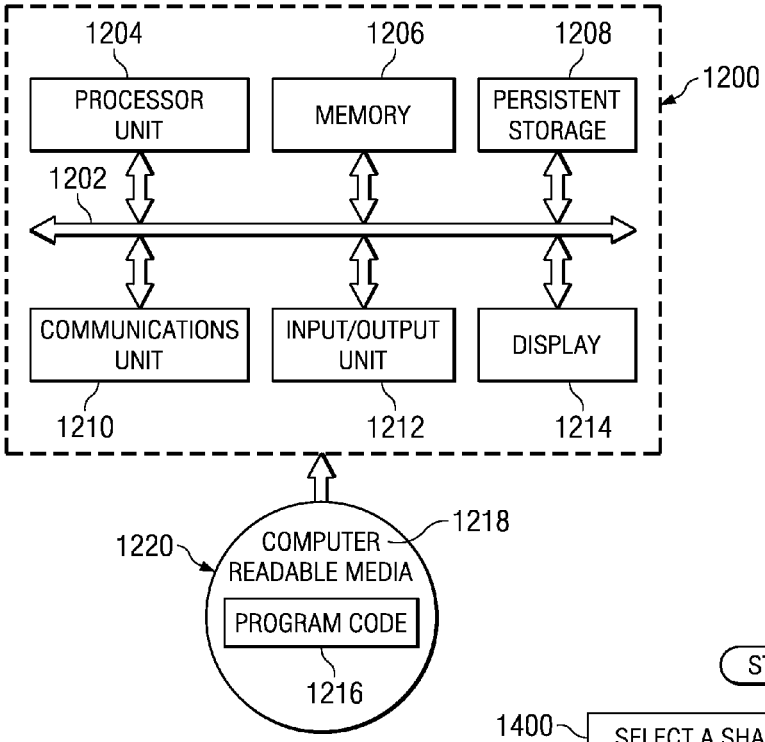
FIG. 12 is a diagram of a data processing system in accordance with an advantageous embodiment.

Turning now to FIG. 12, a diagram of a data processing system is depicted in accordance with an advantageous embodiment. Data processing system 1200 in FIG. 12 is an example of a data processing system that may be used to create designs for negative index metamaterial lenses as well as perform simulations of those lenses within a phased array antenna. Data processing system 1200 also may be used to design and perform simulations on unit cells for the lenses.

In this illustrative example, data processing system 1200 includes communications fabric 1202, which provides communications between processor unit 1204, memory 1206, persistent storage 1208, communications unit 1210, input/output (I/O) unit 1212, and display 1214.

Processor unit 1204 serves to execute instructions for software that may be loaded into memory 1206. Processor unit 1204 may be a set of one or more processors or may be a multi-processor core, depending on the particular implementation. Further, processor unit 1204 may be implemented using one or more heterogeneous processor systems in which a main processor is present with secondary processors on a single chip. As another illustrative example, processor unit 1204 may be a symmetric multi-processor system containing multiple processors of the same type.

Memory 1206 and persistent storage 1208 are examples of storage devices. A storage device is any piece of hardware that is capable of storing information either on a temporary basis and/or a permanent basis. Memory 1206, in these examples, may be, for example, a random access memory or any other suitable volatile or non-volatile storage device. Persistent storage 1208 may take various forms depending on the particular implementation.

For example, persistent storage 1208 may contain one or more components or devices. For example, persistent storage 1208 may be a hard drive, a flash memory, a rewritable optical disk, a rewritable magnetic tape, or some combination of the above. The media used by persistent storage 1208 also may be removable. For example, a removable hard drive may be used for persistent storage 1208.

Communications unit 1210, in these examples, provides for communications with other data processing systems or devices. In these examples, communications unit 1210 is a network interface card. Communications unit 1210 may provide communications through the use of either or both physical and wireless communications links.

Input/output unit 1212 allows for input and output of data with other devices that may be connected to data processing system 1200. For example, input/output unit 1212 may provide a connection for user input through a keyboard and mouse. Further, input/output unit 1212 may send output to a printer. Display 1214 provides a mechanism to display information to a user.

Instructions for the operating system and applications or programs are located on persistent storage 1208. These instructions may be loaded into memory 1206 for execution by processor unit 1204. The processes of the different embodiments may be performed by processor unit 1204 using computer implemented instructions, which may be located in a memory, such as memory 1206. These instructions are referred to as program code, computer usable program code, or computer readable program code that may be read and executed by a processor in processor unit 1204. The program code in the different embodiments may be embodied on different physical or tangible computer readable media, such as memory 1206 or persistent storage 1208.

Program code 1216 is located in a functional form on computer readable media 1218 that is selectively removable and may be loaded onto or transferred to data processing system 1200 for execution by processor unit 1204. Program code 1216 and computer readable media 1218 form computer program product 1220 in these examples. In one example, computer readable media 1218 may be in a tangible form, such as, for example, an optical or magnetic disc that is inserted or placed into a drive or other device that is part of persistent storage 1208 for transfer onto a storage device, such as a hard drive that is part of persistent storage 1208.

In a tangible form, computer readable media 1218 also may take the form of a persistent storage, such as a hard drive, a thumb drive, or a flash memory that is connected to data processing system 1200. The tangible form of computer readable media 1218 is also referred to as computer recordable storage media. In some instances, computer readable media 1218 may not be removable.

Alternatively, program code 1216 may be transferred to data processing system 1200 from computer readable media 1218 through a communications link to communications unit 1210 and/or through a connection to input/output unit 1212. The communications link and/or the connection may be physical or wireless in the illustrative examples. The computer readable media also may take the form of non-tangible media, such as communications links or wireless transmissions containing the program code.

The different components illustrated for data processing system 1200 are not meant to provide architectural limitations to the manner in which different embodiments may be implemented. The different illustrative embodiments may be implemented in a data processing system including components in addition to or in place of those illustrated for data processing system 1200. Other components shown in FIG. 12 can be varied from the illustrative examples shown.

As one example, a storage device in data processing system 1200 is any hardware apparatus that may store data. Memory 1206, persistent storage 1208 and computer readable media 1218 are examples of storage devices in a tangible form.

In another example, a bus system may be used to implement communications fabric 1202 and may be comprised of one or more buses, such as a system bus or an input/output bus. Of course, the bus system may be implemented using any suitable type of architecture that provides for a transfer of data between different components or devices attached to the bus system. Additionally, a communications unit may include one or more devices used to transmit and receive data, such as a modem or a network adapter. Further, a memory may be, for example, memory 1206 or a cache such as found in an interface and memory controller hub that may be present in communications fabric 1202.

Figure 13:
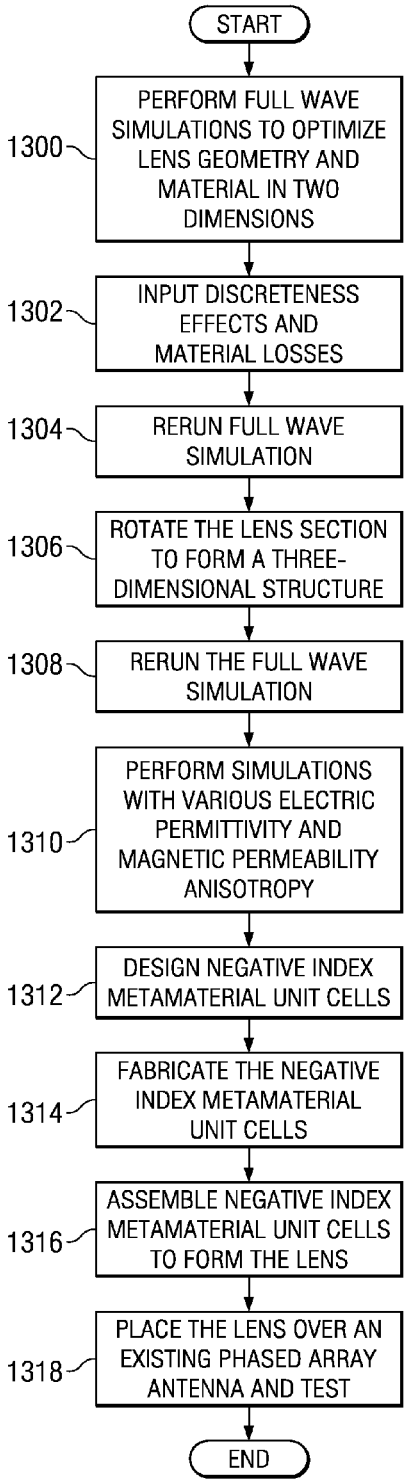
FIG. 13 is a flowchart of a process for manufacturing a negative index metamaterial lens for a phased array antenna in accordance with an advantageous embodiment.

Turning now to FIG. 13, a flowchart of a process for manufacturing a negative index metamaterial lens for a phased array antenna is depicted in accordance with an advantageous embodiment. In this example, the process may be used to create a lens, such as lens 600 in FIG. 6. The different steps involving design, simulations, and optimizations may be performed using a data processing system, such as data processing system 1200 in FIG. 12.

The process begins by performing full wave simulations to optimize lens geometry and material in two dimensions (operation 1300). In operation 1300, the full wave simulation is a known type of simulation involving Maxwell's equations for electromagnetism. This type of simulation involves solving full wave equations with all the wave effects taken into account. In operation 1300, the lens geometry and the material to bend the beam from around 60 degrees steering to around 90 degrees steering is optimized using the simulations. This 90 degrees steering is from horizontal for near horizontal scanning in a phased array antenna.

Thereafter, the process inputs discreteness effects and material losses (operation 1302). The discreteness takes into account that negative index metamaterial unit cells are used to form the lens. With this type of material, a smooth surface may not be possible. The process then reruns the full wave simulation with the discreteness effects and material losses (operation 1304). This operation confirms that the performance identified in operation 1300 is still at some acceptable level with losses and fabrication limitations.

Thereafter, the lens section is rotated to form a three-dimensional structure (operation 1306). The process then reruns the full wave simulation using the three-dimensional structure (operation 1308). Operation 1308 is used to confirm whether the lens geometry and materials optimized in a two-dimensional model are still valid in a three-dimensional model.

The process then performs simulations with various electric permittivity and magnetic permeability anisotropy (operation 1310). The simulations in operation 1310 are also full wave simulations. The difference in this simulation is that full isotropic materials are used with respect to previous simulations. The simulation in operation 1310 may be run using different levels of anistroptry to determine if reduced materials may be used. This operation may be performed to find reduced materials to make fabrication easier with acceptable or reasonable performance.

A reduced material is an anistroptric material that only couples to E and H fields in one or two selected directions, rather than all three directions like an isotropic material. A reduced material may be desirable because of easier fabrication. For example, rather than stacking unit cells in all three directions, fabrication of cells is easier if only two directions or one direction is used. Next, the negative index metamaterial unit cells are designed (operation 1312). In this example, parameters are identified for a negative index metamaterial unit cell to allow for the operation of the desired frequencies and correct anisotropy.

The process fabricates the negative index metamaterial unit cells (operation 1314). In operation 1314, the fabrication of the unit cells may be performed using various currently available fabrication processes. These processes may include those used for fabricating semiconductor devices. The process assembles the negative index metamaterial unit cells to form the lens (operation 1316). In this operation, the final lens with the appropriate geometry orientation, material anisotropy, and mechanical integrity is formed. The fabricated lens is then placed over an existing phased array antenna and tested (operation 1318), with the process terminating thereafter. Operation 1318 confirms whether the lens bends the beam as predicted by the simulations.

Figure 14:
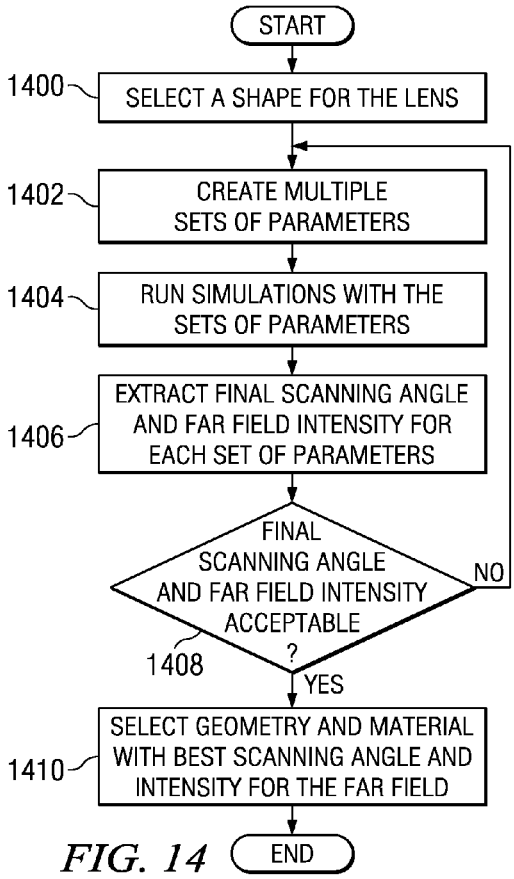
FIG. 14 is a flowchart of a process for optimizing a lens design in accordance with an advantageous embodiment.

With reference now to FIG. 14, a flowchart of a process for optimizing a lens design is depicted in accordance with an advantageous embodiment. The process illustrated in FIG. 14 is a more detailed explanation of operation 1300 in FIG. 13.

The process begins by selecting a shape for the lens (operation 1400). In these examples, the shape is a pair of ellipses that encompass an area to define a lens. Of course, in other embodiments, other shapes may be selected. Even arbitrary shapes may be selected, depending on the particular implementation. The pair of ellipses includes an inner ellipse with a semi-minor axis, a semi-major axis, and an outer ellipse with a similar axis.

The process creates multiple sets of parameters for the selected shape (operation 1402). In these different sets, various parameters for the shape and material of the lens may be varied. In these examples, the parameters for the semi-major and semi-minor axis may be varied. With this particular example, some constraints may include selecting the semi-minor axis and the semi-major axis of the inner ellipse as being larger than the nominal dimension of the antenna array. Further, the semi-minor axis of the inner ellipse is less than the semi-minor axis of the outer ellipse. Additionally, the semi-major axis of the inner ellipse is always less than the semi-major axis of the outer ellipse.

In the different advantageous embodiments, the semi-minor axis of the inner ellipse may be fixed for the different sets of parameters, while the size and eccentricities of the inner and outer ellipse are varied by changing the other parameters in a range centered about the initial values. Further, the negative index of refraction also may be varied.

The process then runs a full wave simulation with the different sets of parameters (operation 1404). The simulations may be run in two dimensions or three dimensions. With large design spaces, a two-dimensional simulation may be performed for faster results. Based on the two-dimensional results, the optimized lens may be rotated in three dimensions, with the simulations then being rerun in three dimensions to verify the results.

The process then extracts the final scanning angle and far field intensity for each set of parameters (operation 1406). Thereafter, a determination is made as to whether the final scanning angle and far field intensity are acceptable (operation 1408).

If the final scanning angle and far field intensity are acceptable, the process selects a geometry and material with the best scanning angle and intensity for the far field (operation 1410), with the process terminating thereafter. In these examples, this simulation may be run without any discreteness in the ellipses. With reference again to operation 1408, if the final scanning angle and far field intensity are not both acceptable, the process returns to operation 1402. The process then creates additional sets of parameters for testing.

The different simulations performed in operation 1404 include full wave electromagnetic simulations. These simulations may be performed using various available programs. For example, COMSOL Multiphysics version 3.4 is an example simulation program that may be used. This program is available from COMSOL AB. This type of simulation simulates the radio frequency transmissions from wave guide elements with a beam pointed in the direction that is desired. Further, the simulation program also simulates the lens with the geometry, materials, and an air box with wave propagation. From these simulations, information about relative far field intensity and final angle of the beam may be identified.

Figure 15:
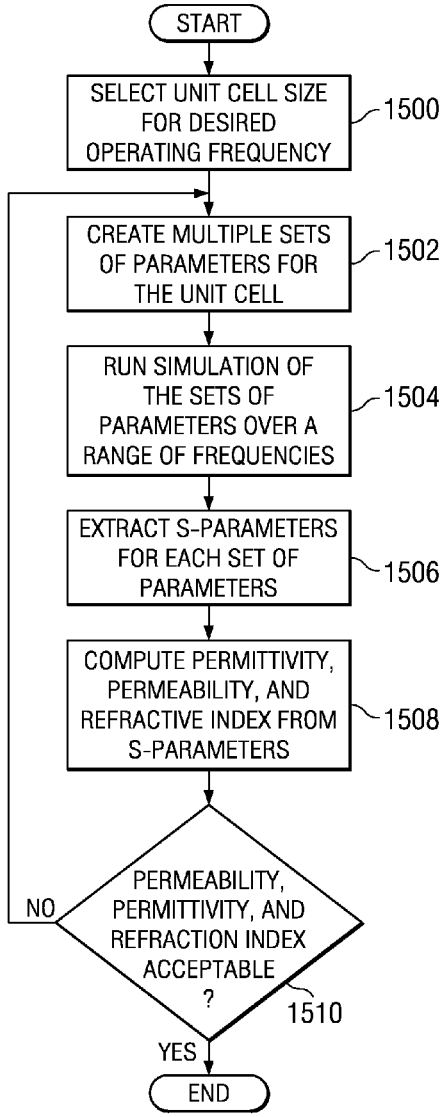
FIG. 15 is a flowchart of a process for designing negative index metamaterial unit cells in accordance with an advantageous embodiment.

With reference now to FIG. 15, a flowchart of a process for designing negative index metamaterial unit cells is depicted in accordance with an advantageous embodiment. The process illustrated in FIG. 15 is a more detailed explanation of operation 1312 in FIG. 13.

The process begins by selecting a unit cell size for the desired operating frequency (operation 1500). In this example, a fixed unit cell size of a 2.3 millimeter cube is selected for an operating frequency of around 15 GHz. In these examples, the unit cell is selected to be smaller than the wave length for effective medium theory to hold. Typical cell sizes may range from around $\lambda/5$ to around $\lambda/20$. Even smaller cell sizes may be used. In these examples, $\lambda$=free space wave length. Although smaller unit cell sizes may be better with respect to performance, these smaller sizes may become too small such that the split ring resonators and wire structures do not have sufficient inductance and capacitance to cause a negative index metamaterial effect.

The process then creates multiple sets of parameters for the unit cell (operation 1502). These parameters are any parameters that may affect the performance of the cell with respect to permittivity, permeability, and the refractive index. Examples of features that may be varied include, for example, without limitation, a width of copper traces for the split ring resonator, width of copper traces for a wire, the amount of separation between split ring resonators, the size of split in the split ring resonator, the size of gaps in the split ring resonator, and other suitable features.

Next, the process runs a simulation on the sets of parameters over a range of frequencies (operation 1504). The simulation performed in operation 1504 may be performed using the same software to perform the simulation of the runs in operation 1404 in FIG. 14. This simulation is a full wave simulation on the unit cell over a range of frequencies.

The process then extracts s-parameters for each set of parameters (operation 1506). In these examples, an s-parameter is also referred to as a scattering parameter. These parameters are used to describe the behavior of models undergoing various steady state stimuli by small signals. In other words, the scattering parameters are values or properties used to describe the behavior of a model, such as an electrical network, undergoing various steady state stimuli by small signals.

Thereafter, the process computes permittivity, permeability, and refractive index values for each of the sets of s-parameters extracted for the different sets of parameters (operation 1508). A determination is then made as to whether any of the permeability, permittivity, and refractive indexes returned are acceptable (operation 1510). If one of these sets of values is acceptable, the process terminates. Otherwise, the process returns to operation 1502 to generate additional sets of parameters for the unit cell.

Figure 16:
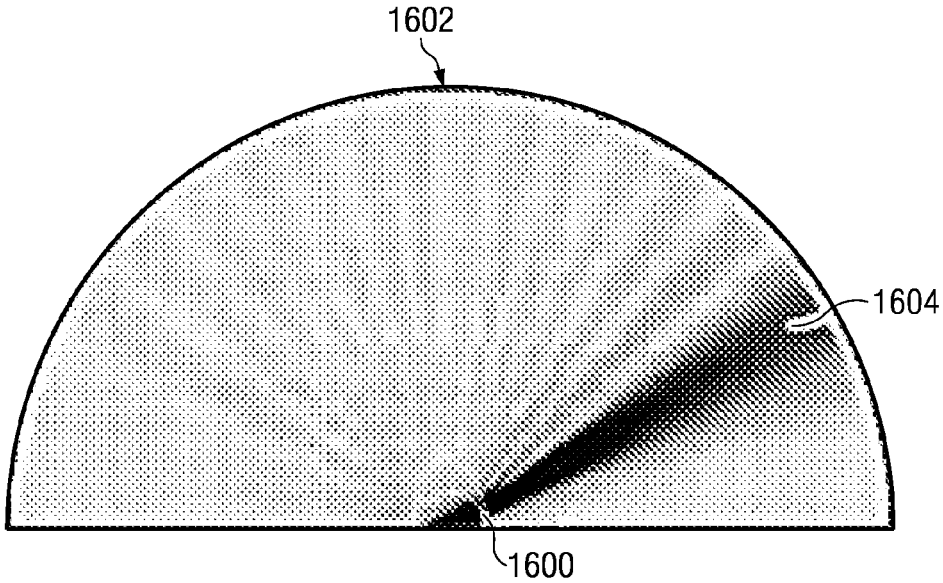
FIGS. 16, 17, and 18 are displays of beams in accordance with an advantageous embodiment.
Figure 17:
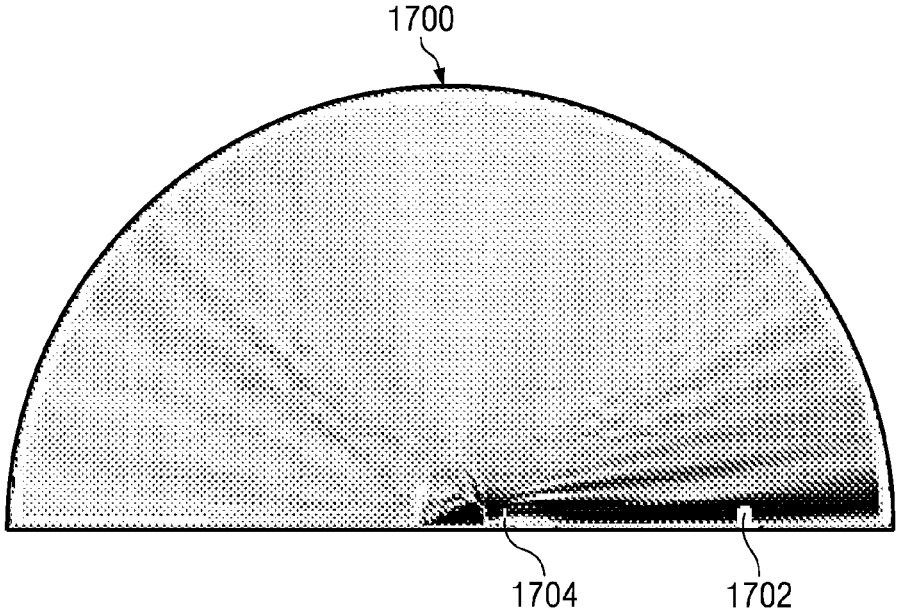
Figure 18:
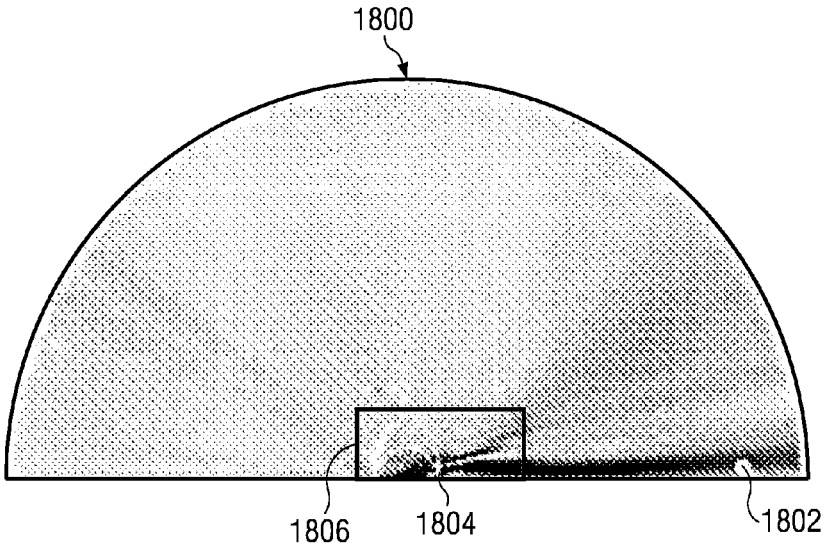

With reference now to FIGS. 16, 17, and 18, a display of beams is depicted in accordance with an advantageous embodiment. These figures illustrate results from simulations of beam transmission from an array. In FIG. 16, a beam is steered at around 60 degrees from a phased array located at point 1600 in display 1602. As can be seen, beam 1604 is around 60 degrees from vertical.

With reference now to FIG. 17, display 1700 illustrates the use of a smooth lens without discrete components. In this example, display 1700 illustrates the bending of beam 1702 to around a horizontal or 90 degree position from a phased array antenna meeting beam 1702 from point 1704.

With reference now to FIG. 18, a display of a beam bent by a lens is depicted in accordance with an advantageous embodiment. In this example, display 1800 illustrates beam 1802 being bent by a lens when projected by an array at around point 1804. Section 1806 is shown in greater detail in FIG. 19 below.

Figure 19:
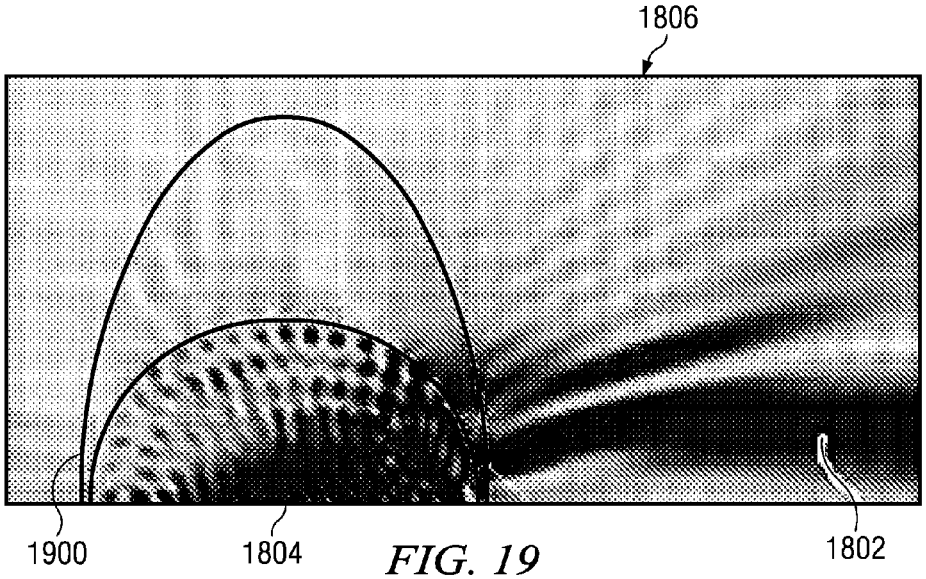
FIG. 19 is a magnified view of a section from FIG. 18 in accordance with an advantageous embodiment.

Turning now to FIG. 19, a magnified view of section 1806 from FIG. 18 is depicted in accordance with an advantageous embodiment. In this example, lens 1900 is shown bending beam 1802 to a direction that is around horizontal or around 90 degrees from a normal direction when emitting an array at point 1804.

Figure 20:
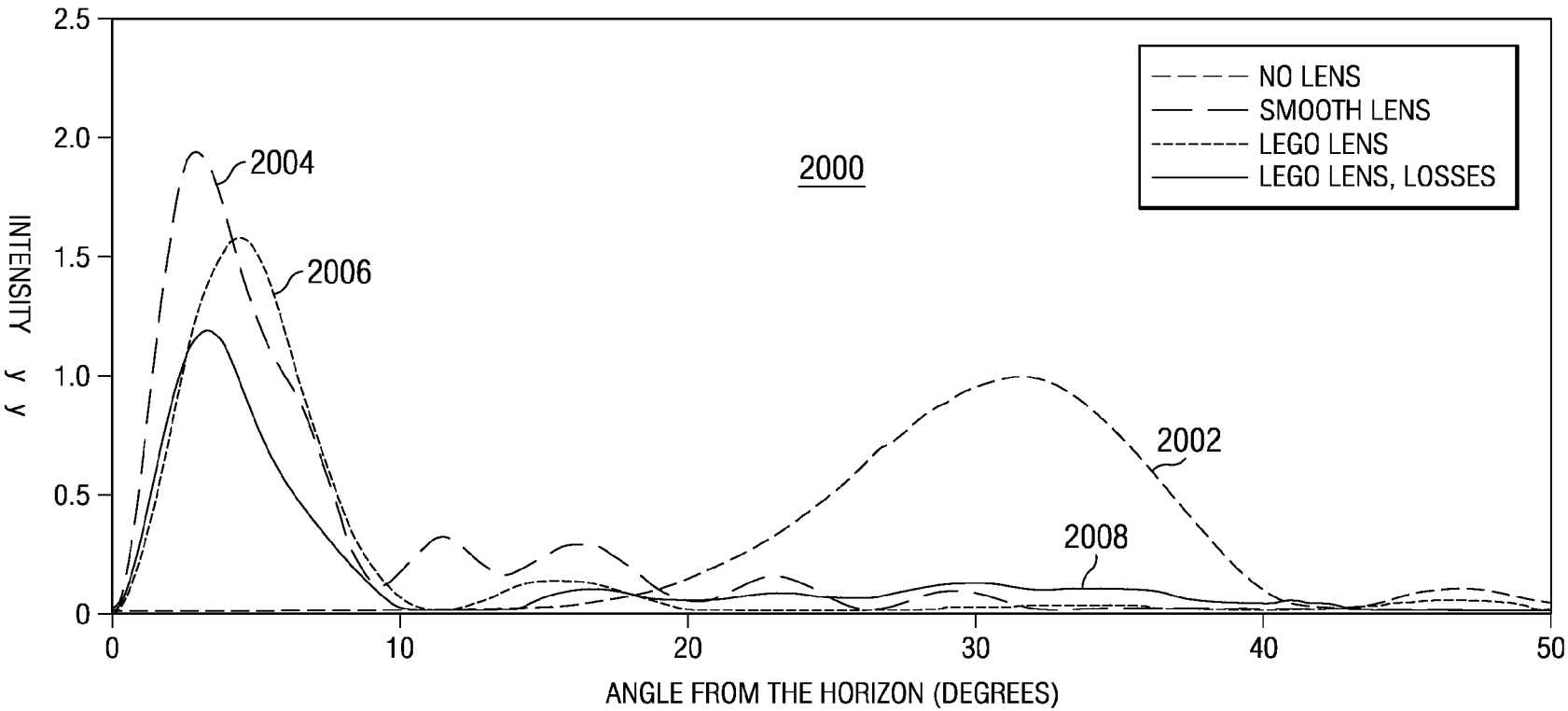
FIG. 20 is an intensity plot in accordance with an advantageous embodiment.

Turning now to FIG. 20, an intensity plot is depicted in accordance with an advantageous embodiment. In this example, plot 2000 contains lines indicating the intensity of a beam at different angles from horizontal. Line 2002 represents the intensity when no lens is used. As can be seen, the intensity of around 0 degrees from the horizon has no intensity while the greatest amount is around 30 degrees from the horizon.

In this example, 30 degrees represents a 60 degree from normal when steering is performed using a phased array. In this example, a 16×1 array is used. Line 2004 represents a smooth lens. Line 2006 represents a lens without losses, while line 2008 represents a lens with losses included in the simulation. As can be seen, the use of a lens increases the intensity at around 0 degrees with respect to the horizon. The intensity is greater with the smooth lens, however, the smooth lens does not represent actual construction of a lens for use with a phased array antenna.

Figure 21:
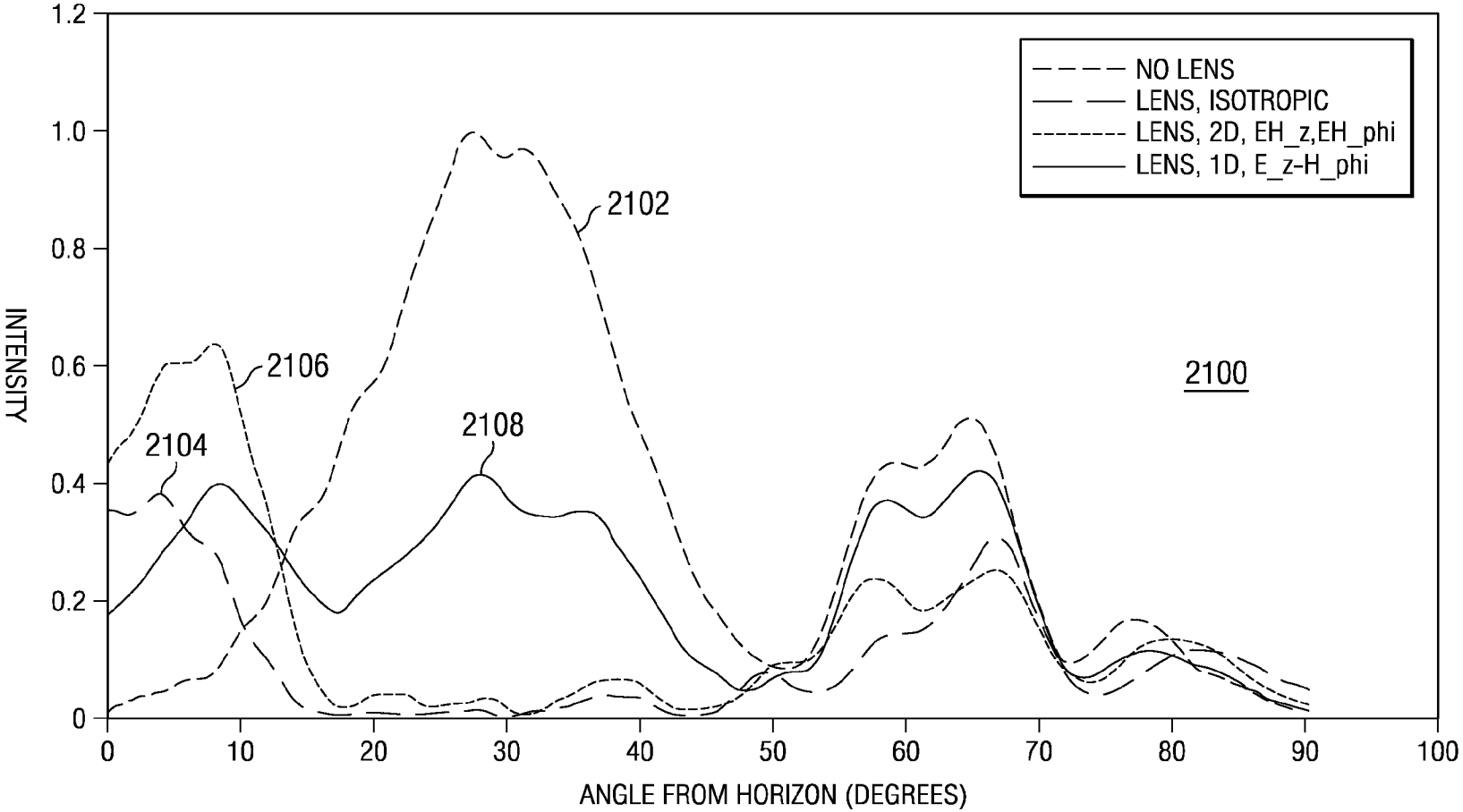
FIG. 21 is another intensity plot in accordance with an advantageous embodiment.

With reference now to FIG. 21, an intensity plot of a beam projected by a phased array antenna is depicted in accordance with an advantageous embodiment. In this example, plot 2100 represents results of a simulation performed with and without a negative index metamaterial lens in which a beam is steered at around 60 degrees.

The simulations in plot 2100 compare various levels of an isotropy in a lens. In plot 2100, line 2102 represents the intensity from different angles from horizontal when no lens is used. As can be seen, the intensity of line 2102 is low when the angle is around horizontal. Line 2104 illustrates the intensity for an isotropic lens. In this example, the refractive index is n equal to around −0.6 in all directions in space. In other words, the material is isotropic. The isotropic lens has a smaller intensity because more material losses occur in all directions. Line 2106 represents a lens made of reduced material having two dimensions.

In this example, a cylindrical coordinate system may be used in which the E and H field in the $\Phi$ and z directions have a value of n equal to around −0.6 and n equal to around 1 in the r direction. Line 2108 represents another lens made of a one dimensional material. In other words, one component of the e field and h field has a negative index metamaterial component. In this example, the permittivity in the z direction is around −0.6 and equals one in the $\Phi$ and r directions. The amount of permeability equals around −0.6 in the $\Phi$ direction and equals one in the r and z direction in a cylindrical coordinate system.

Thus, the different advantageous embodiments provide a new application for a negative index metamaterial lens for steering beams projected or emitted by a phased array antenna. In the different advantageous embodiments, the negative index metamaterial lenses enhance the scanning angle of phased array antennas. In the different advantageous embodiments, unit cell designs are used to form the negative index metamaterial lenses. Although particular cell designs are presented in the different illustrations, any cell design may be used that achieves the desired properties when a beam is passed through the lens.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for creating a negative index metamaterial lens for use with a phased array antenna, the method comprising:

creating a design for the negative index materials lens that bends a beam generated by the phased array antenna to a selected angle relative to a normal vector, wherein creating a design includes selecting an outline of the lens defined by a rotation of a first curve about the normal vector and a rotation of a second curve about the normal vector, the second curve positioned inside the first curve, and the lens outline further having a top section removed from the lens;

modifying the design to include discrete components to form a discrete design;

selecting materials for the discrete components;

designing negative index metamaterial unit cells for the discrete components to form designed negative index metamaterial unit cells;

fabricating the designed negative index metamaterial unit cells to form fabricated designed negative index metamaterial unit cells; and forming the negative index metamaterial lens from the designed negative index metamaterial unit cells, wherein the cells are substantially positioned within the first curved surface and the second curved surface of the lens.

2. The method of claim 1 further comprising:

placing the negative index metamaterial lens into the phased array antenna.

3. A method for creating a lens for a phased array antenna, the method comprising:

identifying an array of radio frequency emitters capable of emitting a beam that is steerable to a first angle relative to a vertical orientation;

creating a design of a negative index metamaterial lens capable of bending the beam emitted by the array of radio frequency emitters to the desired angle relative to the vertical orientation, wherein the creating step further comprises selecting a shape for the negative index metamaterial lens, an outline of the lens defined by a rotation of a first curve about a normal vector and a rotation of a second curve about a normal vector, the second curve positioned inside the first curve, and the lens outline further having a top section removed from the lens; and selecting a material for the negative index metamaterial lens based on the shape that cause the negative index metamaterial lens to bend the beam emitted by the array of radio frequency emitters to the desired angle relative to the vertical orientation; and forming a negative index metamaterial lens from the design, the lens capable of bending the beam emitted by the array of radio frequency emitters to a desired angle relative to the vertical orientation.

4. The method of claim 3, wherein the step of selecting the material for the negative index metamaterial lens based on the shape that cause the negative index metamaterial lens to bend the beam emitted by the array of radio frequency emitters to the desired angle relative to the vertical orientation comprises:

selecting a material having a negative index of refraction that is capable of causing the beam emitted by the array of radio frequency emitters to bend the beam to the desired angle relative to the vertical orientation when used in the shape.

5. The method of claim 4, wherein the material comprises a plurality of discrete components.

6. The method of claim 5, wherein the plurality of discrete components comprises:

a plurality of negative index metamaterial unit cells.

7. The method of claim 3, wherein the creating step comprises:

selecting a shape for the negative index metamaterial lens to form an initial design;

modifying the initial design to include discrete components to form a discrete design;

selecting materials for the discrete components;

designing negative index metamaterial unit cells for the discrete components to form designed negative index metamaterial unit cells;

fabricating the designed negative index metamaterial unit cells to form fabricated designed negative index metamaterial unit cells; and forming the negative index materials lens from the designed negative index metamaterial unit cells.

8. The method of claim 7, wherein the step of designing negative index metamaterial unit cells for the discrete components to form the designed negative index metamaterial unit cells comprises:

selecting a substrate for the negative index metamaterial unit cells;

selecting features of the negative index metamaterial unit cells to obtain a desired index of refraction.

9. The method of claim 8, wherein the step of selecting the features of the negative index metamaterial unit cells comprises:

selecting parameters for a split ring resonator.

10. The method of claim 9, wherein the parameters for the split ring resonator comprise a width of copper traces in the split ring resonator, a separation between the split ring resonator, a size of gaps in the split ring resonator; and a size of splits in the split ring resonator.

11. The method of claim 3 further comprising:

placing the negative index metamaterial lens into the phased array antenna containing the array of radio frequency emitters.

12. An apparatus comprising:

a phased array antenna emitting a radio frequency beam;

a negative index metamaterial lens having a configuration that bends the radio frequency beam to a selected angle relative to a normal vector, the negative index metamaterial lens comprising a plurality of discrete components; and a negative metamaterial lens having a lens outline defined by a rotation of a first curve about the normal vector and a rotation of a second curve about the normal vector, the second curve positioned inside the first curve, such that the discrete components are substantially positioned between the rotation of the first curve and the rotation of the second curve, and the lens outline further having a top section removed from the lens.

13. The apparatus of claim 12, wherein the plurality of discrete components comprises a plurality of negative index metamaterial unit cells arranged in the configuration.

14. The apparatus of claim 13 wherein the plurality of negative index metamaterial unit cells comprise a crystalline stacking.

15. The apparatus of claim 14 wherein the crystalline stacking further comprises a plurality of layers of unit cells wherein the height of a layer is one unit cell thick.

16. The apparatus of claim 12 wherein the first curve and the second curve are selected from curves that are substantially parabolic or substantially elliptical.

17. The apparatus of claim 12 wherein the rotation of the second curve comprises an inner elliptical surface and wherein a semi-minor axis and the semi-major axis of the inner elliptical surface are large than a nominal dimension of the antenna array.

* * * * *